US007056147B2

(12) United States Patent
Arias et al.

(10) Patent No.: US 7,056,147 B2
(45) Date of Patent: Jun. 6, 2006

(54) MULTI-TERMINAL CONNECTOR STRIP AND PROCEDURE FOR THE SEALING THEREOF

(75) Inventors: Juan Tomas Arias, Madrid (ES); Jose Vicente Gimeno, L'Alcudia (ES)

(73) Assignee: Tyco Electronics Raychem S.A. (ES)

( * ) Notice: Subject to any disclaimer, the term of this patent is extended or adjusted under 35 U.S.C. 154(b) by 0 days.

(21) Appl. No.: 10/494,235

(22) PCT Filed: Oct. 24, 2002

(86) PCT No.: PCT/GB02/04810

§ 371 (c)(1),
(2), (4) Date: May 3, 2004

(87) PCT Pub. No.: WO03/043136

PCT Pub. Date: May 22, 2003

(65) Prior Publication Data

US 2005/0018385 A1 Jan. 27, 2005

(30) Foreign Application Priority Data

Nov. 14, 2001 (ES) ..... 200102520

(51) Int. Cl.
*H01R 4/24* (2006.01)

(52) U.S. Cl. ..... 439/417; 439/404

(58) Field of Classification Search ..... 439/417, 439/418–419, 395–404, 409–413; 361/119, 361/56, 58, 111, 113, 115, 127
See application file for complete search history.

(56) References Cited

U.S. PATENT DOCUMENTS

| | | | | |
|---|---|---|---|---|
| 5,333,193 | A * | 7/1994 | Cote et al. | 379/413.04 |
| 5,416,837 | A * | 5/1995 | Cote et al. | 379/413.02 |
| 5,423,694 | A * | 6/1995 | Jensen et al. | 439/417 |
| 5,508,877 | A * | 4/1996 | Smith | 361/119 |
| 5,548,641 | A * | 8/1996 | Butler et al. | 379/413.04 |
| 5,570,422 | A * | 10/1996 | Napiorkowski et al. | 379/413.02 |
| 5,588,869 | A * | 12/1996 | Jensen et al. | 439/417 |
| 6,025,982 | A * | 2/2000 | Brower | 361/119 |

OTHER PUBLICATIONS

International Preliminary Examination Report for PCT/GB02/04810.
International Search Report for PCT/GB 02/04810.

* cited by examiner

*Primary Examiner*—J. F. Duvern
(74) *Attorney, Agent, or Firm*—Myers Bigel Sibley & Sajovec

(57) ABSTRACT

A strip is provided with a series of housings for a like number of terminals to which conductor wires accede thrust by a tool in order to establish a connection, by means of displacing the conductor wires over the terminals. Each housing or chamber is independent of those adjacent, the separation being constituted by means of transversal partitions, which makes possible the pouring of a sealing gel into the respective housing chamber up to a level which is at a height lower than the entrance step of the conductor wires and above the edge of the terminals, with the objective that both said terminals and the connections thereof with the conductors be immersed in the sealing gel in order to prevent oxidation on the connections.

9 Claims, 3 Drawing Sheets

MULTI-TERMINAL CONNECTOR STRIP AND PROCEDURE FOR THE SEALING THEREOF

RELATED APPLICATIONS

The present application is a National Phase application of PCT/GB02/04810 filed on Oct. 24, 2002 and published in English, which claims priority from Application ES 200102520 filed on Nov. 14, 2001.

BACKGROUND OF THE INVENTION

The innovation of the strip consists in the internal configuration of the terminal housing chambers, and also in that said chambers are made independent by means of transversal partitions.

A further object of the invention is a procedure for sealing the strip, said sealing being performed by pouring suitable gel or fluid up to a determined height in each of the chambers in which the terminal is located, so that when it has cured, the conductor wires are housed and duly connected.

Multi-terminal connection strips are known that employ pairs of terminals fixed to each other in an elongated row for their connection, and the terminals of which are capable of displacing the insulation of the conductors which are inserted by pushing and by means of a tool between the corresponding parts of the terminals, producing the displacement of the insulating sleeve in order to establish the connection between said conductors and the actual terminals. That is, the connection is not made by cutting wires, nor by stripping their ends, but by thrusting the wire with the tool against the actual terminals, it being the latter which displace the insulation and establish the connection as has just been explained.

Notwithstanding, though this connection system proves effective, it has a drawback, and this is that the chambers or housings for the respective terminals are open to the air, it being possible for dampness to enter on the pertinent conductor which could give rise to a subsequent process oxidation, which can be worsened due to the frequency at which the signal is transmitted, since higher signal frequencies produce increased oxidation.

A manner which is employed to prevent said oxidation, consists in coating the outside of the strip with a sealing agent, such as a fluid, a gel or other suitable product, which is generally applied by pouring and left to dry, all this in a manner whereby said fluid or sealing agent extends through the slots that define the housings of the strip, the curing of the sealing product occurring, said product remaining compact though flexible.

In other cases, in order to prevent oxidation, grease is employed as a sealing agent, which, by its very nature does not require curing, but which even so is lost on connecting the wires, and also the actual tool which acts on the terminals, strips away part of the grease when the operation is performed, leaving spaces open to the air and consequently subject to the aforementioned oxidation.

Thus, in order for the fluid in question not to be displaced and lost while drying, the strip is inserted into a mould covering the slots existing, which clearly does not signify an effective solution.

In other cases, as a means for blocking the slots, gums are employed, with the objective of preventing the liquid from escaping before it has cured. The drawback that this last system has, is that the gums are of a limited duration, that is, very short, around a couple of days, meaning that they have to be changed continuously.

SUMMARY OF THE INVENTION

The strip which is proposed herein has been designed to overcome all of the problems outlined above, and is based on a straightforward but highly effective solution, a solution which affects both the configuration of the housings or chambers in which the terminals are lodged, and the relative covered zone.

More specifically, the strip of the invention is characterised in that the housings or chambers for the different terminals are independent and are separated by pertinent transversal partitions, which determines that each terminal is lodged in a completely independent housing that can be filled with the suitable sealing product. In a word, each terminal pair is separated from the adjacent pairs, by means of main partitions, and, in turn, the two terminals which constitute a pair, are separated by respective intermediate partitions.

The intermediate transversal partitions situated between the terminals that form a pair, are of less height that the main partitions in order to be able to augment the volume of sealant, and simultaneously increase the effectiveness of the sealing that it provides while managing to lose the least amount possible of sealant during the sealing operation and subsequent connection of the conductors.

Another innovative characteristic which the strip of the invention offers, is that internally the housings or chambers in which the terminals are lodged, have some recesses or steps for the correct positioning of the terminal, since the latter has a special configuration, all of this so that the thrust by means of the pertinent tool results not only in the displacement of the wires over the terminals and the sectioning of the excess wire to establish the connection, but also means of support are determined both for the fins which form part of the terminals and of the wires themselves in their final emplacement.

Moreover, the particular and internal configuration of the aforementioned chambers that house the terminals, is such that the upper extremity of the terminals is left at a level lower than the side edge of the strip and, of course, also below the rim of the transversal partitions that separate or delimit the housings or chambers.

With regard to the sealing procedure, this is based on pouring a sealing gel or fluid over the pertinent chamber housing the terminals once they have been suitably mounted, with the particularity that the height that has to be reached by the sealing gel on the inside of the chamber or housing shall be at a lower level of the step corresponding to the lateral entry slot of the cables, whereby the whole terminal and the point of contact with the cable are immersed and nevertheless the sealing fluid does not overflow on any side.

Clearly the sealing procedure consists in pouring over the chamber or housing of the terminals, a quantity of suitable sealing gel or fluid until a level is reached that is located above the upper level of the terminals and below the upper level of the side edges of the actual strip, all of this in order to achieve that both the terminals and the zone of contact between the terminal and the conductor wires are completely immersed in the gel, so that once dried or cured it is possible to proceed to the location and subsequent connection of the conductor wires with the collaboration of the tool, without risk of loss or extension of the sealing product itself.

To achieve this, the sealing gel or product which is employed, once it has dried or cured, acquires a gelatinous or semi-solid state with a certain degree of elasticity, in such a way that it permits insertion therein of the tool together with the conductor wire, and also when the wire has been connected and the tool removed, said elastic property of the gelatinous mass causes the gel to recover its initial volume (prior to the insertion of the tool), and closes the space which the tool originated on its insertion, whereby the chamber is perfectly flooded with sealing gel or product which guarantees the seal.

BRIEF DESCRIPTION OF THE DRAWINGS

To complete the description that shall be made below and with the object of assisting in a better understanding of the characteristics of the invention, accompanying the present descriptive specification and forming an integral part thereof, is a set of drawings in which by way of illustration and not restrictively, the following is shown.

DETAILED DESCRIPTION OF EMBODIMENTS OF THE INVENTION

As can be seen from the figures referenced, the strip (1) of the invention, constituted by an elongated body in which are formed the pertinent housings or chambers (2) for each pair of terminals (3), has the particularity that each one of its housings or chambers (2) is made separate and independent of the rest by means of respective transversal partitions (4).

Figure 1:
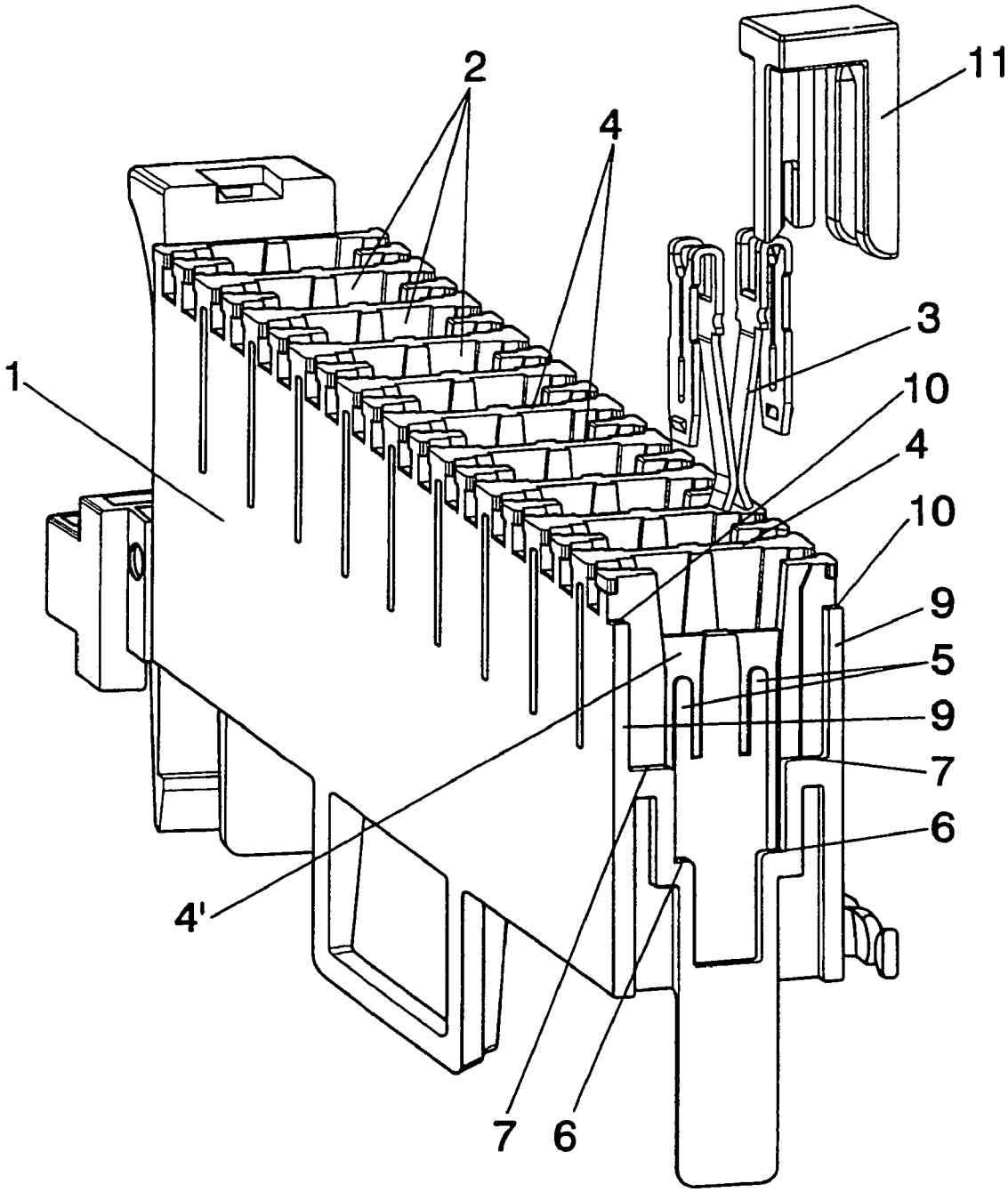
FIG. 1.—Shows a view according to one perspective in cross section of a strip with the improvements of the invention, it being possible to see the internal configuration of the compartments or chambers for the various terminals, one of which is presented in exploded form and in position for mounting in the corresponding chamber or housing, and also the respective tool by means of which the conductor wires shall be pushed in order to establish the connection with the terminal.
Figure 2:
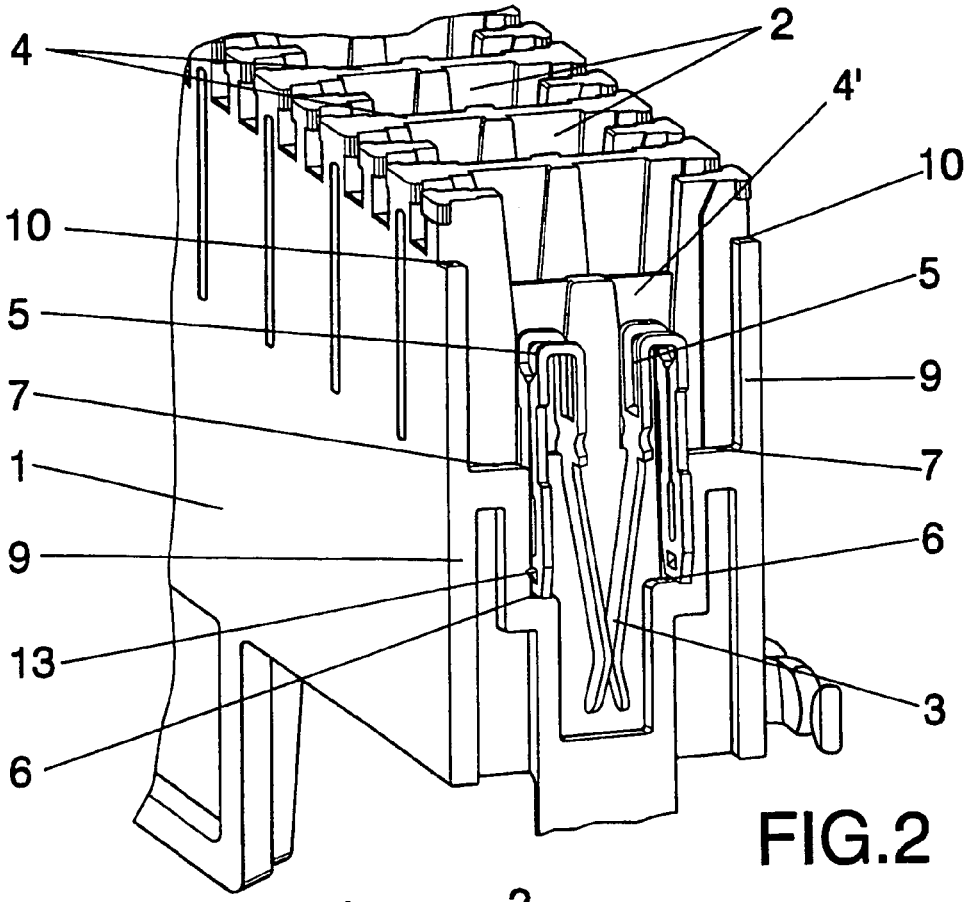
FIG. 2.—Shows a drawing according to one perspective of part of the strip which is represented in FIG. 1, with the terminal duly mounted.

Moreover, between each of the terminals (3) which forms a pair, there are other transversal and intermediate partitions (4') of less height with the object of occupying the least possible volume within the chamber (2) and so permit the pouring in of a greater quantity of sealing product with the object of enhancing its effectiveness and minimising the loss of sealing product during the sealing operation that shall be explained later. Specifically the level of the intermediate partitions (4') is situated close to and above the highest level of the terminals (3), just as is shown in FIG. 2.

Internally these housings or chambers have a particular configuration with projections, steps and shoulders, determining on one hand supports for positioning (5) for the side arms of the actual terminals (3), and also as supports (6) or steps for the extremities of said side arms of the terminals (3), there also being some steps (7) formed for the conductor wires (8). Likewise, the housings or chambers (2) are delimited on the sides by means of corresponding edges (9) the upper extremity of which constitutes a support or step of the slot (10) for the respective cable (8).

Figure 3:
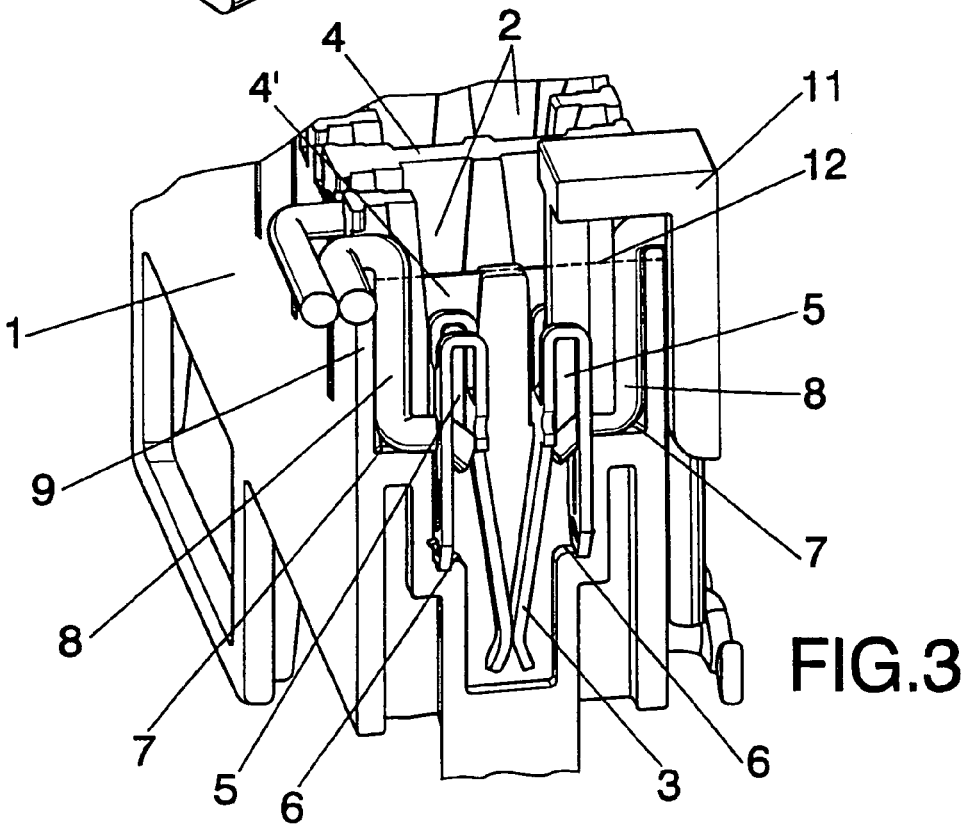
FIG. 3.—Shows another perspective of the strip with the conductor wires connected to the terminal, a tool having been drawn in the situation of having pushed the pertinent cable conductor totally up against the step of the chamber housing the terminal and also establishing contact with the latter.
Figure 4:
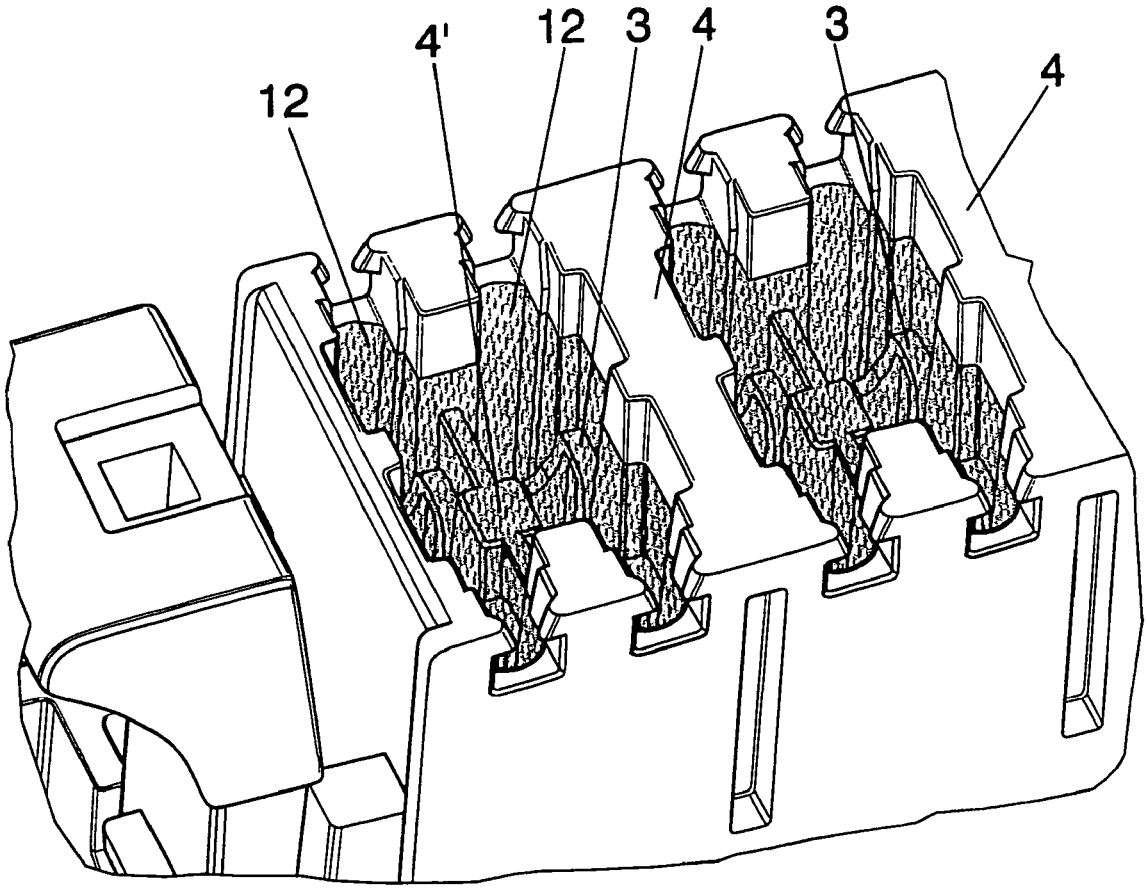
FIG. 4.—Shows, finally, a perspective of the upper part of the strip, in which are seen the levels of the distinct intermediate transversal partitions, the location of the contacts and the sealing product.

The terminals (3), as can be seen in the figure, have two fins which make mutual contact via one of their extremities whilst via the other they diverge and after some bends expand into laminar forms and it is these which are positioned on the inside of steps (5) and (6), laminar forms in which a longitudinal slot with cutting edges is practiced so that when the conductor wires (8) are introduced through those slots of the terminals (3) sectioning takes place and the corresponding displacement of the insulating material of the conductor wires (8), and the connection is established between the conductor which in each case constitutes the wire, with the pertinent terminal, as is shown in FIG. 3.

Said terminals (3), more specifically in the vicinity of the free extremity of their laminar forms, have a projection (13) the purpose of which is to secure the terminal (3) itself by piercing the plastic of the strip (1) itself.

The pertinent sealing is carried out by pouring a suitable fluid, gel or sealing product, into the interior of the chamber or housing (2) until a level (12) is reached, said level (12) being at a lower height of the entrance step (10) of the conductor wires (8), corresponding to the side edges (9) of the strip (1) itself thereby preventing the overflow or escape of the gel and nevertheless achieving that both the terminals (3) and the connection zone above these of the conductors (8) are immersed in said gel.

When the sealing product has dried or cured, the positioning of the conductor wires (8) and their connection to the terminals (3) are performed, in such a manner that the conductor wires (8) are thrust into their connection position by means of a tool (1) which is guided via the actual terminals (3) and side edges (9), positioning itself correctly on these and establishing their connection in the aforementioned manner, it being possible to see in FIG. 3 how those conductor wires (8) first find support on the internal step (7) and then, now in correspondence with their part proceeding to the exterior, on the step of the slot (10) which defines the upper extremity of the side projections (9).

After the tool has been withdrawn, due to the elastic property of the gel or sealing product, the latter expands and covers completely the space that had been produced by tool. Either the tool, or the surface of the gel or sealing product, or both, are preferably coated with a low-adhesion material such as silicone, or talc, or preferably a fluoropolymer such as polytetrafluoroethylene in order to reduce or minimise undesirable damage to or removal of the gel or sealing product on insertion and removal of the tool.

The invention claimed is:

1. A method for sealing a multi-terminal connector strip including an elongated body incorporating a series of chambers for a like number of terminals configured to be connected to conductor wires by thrusting the conductor wires into the interior of the chamber by means of a suitable tool, thereby thrusting the conductor wires into slots of the terminals which cause cutting of the wire insulation in order to establish electrical connection of the wires with the terminals, wherein the chamber for each pair of terminals has sidewalls extending a height above the terminals and is separated from each adjacent chamber by means of respective transverse partitions, so as to permit the pouring of a gel or sealing product into each one of the chambers, in order to protect the conductor wires, the method comprising:

pouring into said chambers a sealing product, until a level is reached above an upper edge of the terminals and below an edge which is defined by an upper entrance step of the conductor wires, corresponding to side edges of the strip itself;

solidifying the poured sealing product; and making of connections between the terminals and the conductor wires, both the terminals and the connections between the latter and the conductor wires being totally immersed in said sealing product.

2. A method according to claim 1 wherein the tool and/or a surface of the sealing product is or are coated with a low-adhesion material to reduce adhesion between the sealing product and the tool.

3. The method of claim 1 wherein the sealing product comprises a gel.

4. A multi-terminal connector strip, comprising:

an elongated body defining a series of chambers;

terminals inserted in the chambers;

a plurality of transverse partitions in the elongated body between the terminals and defining a common wall between adjacent ones of the chambers, the transverse partitions and sidewalls of the chambers defined by the elongated body having a height above a height of a conductor wire receiving slot of the terminals and wherein one of the sidewalls is configured to receive and guide a tool that thrusts a conductor wire into the conductor wire receiving slot of one of the terminals to cut wire insulation of the conductor wire to establish electrical connection of the wire with the one of the terminals; and a sealing product in the chambers up to a level above the height of the conductor wire receiving slot of the terminals and below an edge defined by an upper entrance step of the conductor wires formed in an upper edge of the sidewalls.

5. The strip of claim 4 wherein the sealing product is solidified in the chambers.

6. The strip of claim 4 further comprising the tool and wherein the tool and/or a surface of the sealing product is or are coated with a low-adhesion material to reduce adhesion between the sealing product and the tool.

7. The strip of claim 4 wherein a plurality of terminals are inserted in each chamber and wherein the strip further comprises and intermediate partition separating the terminals within a chamber.

8. The strip of claim 7 wherein the sidewalls further include terminal receiving steps in the chambers configured to receive corresponding parts of the terminals to position the terminals in the chambers.

9. The strip of claim 8 wherein the sidewalls further include conductor wire receiving steps in the chambers configured to receive conductor wires inserted into the conductor wire receiving openings of the terminals.

* * * * *